US006906271B2

(12) United States Patent
Fong et al.

(10) Patent No.: US 6,906,271 B2
(45) Date of Patent: Jun. 14, 2005

(54) FLUID-BASED SWITCH

(75) Inventors: Arthur Fong, Colorado Springs, CO (US); Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 143 days.

(21) Appl. No.: 10/413,851

(22) Filed: Apr. 14, 2003

(65) Prior Publication Data

US 2004/0200704 A1 Oct. 14, 2004

(51) Int. Cl.[7] ..... H01H 29/00

(52) U.S. Cl. ..... 200/182; 200/193

(58) Field of Search ..... 200/182, 183, 200/185, 188, 190–194, 198, 228, 241, 220–224, 233–235, 199, 243

(56) References Cited

U.S. PATENT DOCUMENTS

| | | | |
|---|---|---|---|
| 2,312,672 | A | 3/1943 | Pollard, Jr. |
| 2,564,081 | A | 8/1951 | Schilling |
| 3,430,020 | A | 2/1969 | Tomkewitsch et al. |
| 3,529,268 | A | 9/1970 | Rauterberg |
| 3,600,537 | A | 8/1971 | Twyford |
| 3,639,165 | A | 2/1972 | Rairden, III |
| 3,657,647 | A | 4/1972 | Beusman et al. |
| 4,103,135 | A | 7/1978 | Gomez et al. |
| 4,200,779 | A | 4/1980 | Zakurdaev et al. |
| 4,238,748 | A | 12/1980 | Goullin et al. |
| 4,245,886 | A | 1/1981 | Kolodzey et al. |
| 4,336,570 | A | 6/1982 | Brower |
| 4,419,650 | A | 12/1983 | John |
| 4,434,337 | A | 2/1984 | Becker |
| 4,475,033 | A | 10/1984 | Willemsen et al. |
| 4,505,539 | A | 3/1985 | Auracher et al. |
| 4,582,391 | A | 4/1986 | Legrand |
| 4,628,161 | A | 12/1986 | Thackrey |
| 4,652,710 | A | 3/1987 | Karnowsky et al. |
| 4,657,339 | A | 4/1987 | Fick |
| 4,742,263 | A | 5/1988 | Harnden, Jr. et al. |
| 4,786,130 | A | 11/1988 | Georgiou et al. |
| 4,797,519 | A | 1/1989 | Elenbaas |
| 4,804,932 | A | 2/1989 | Akanuma et al. |

(Continued)

FOREIGN PATENT DOCUMENTS

| | | |
|---|---|---|
| EP | 0593836 A1 | 4/1994 |
| FR | 2418539 | 9/1979 |
| FR | 2458138 | 12/1980 |
| FR | 2667396 | 4/1992 |
| JP | 36-18575 | 10/1961 |
| JP | 47-21645 | 10/1972 |
| JP | 62-276838 | 12/1987 |
| JP | 63-294317 | 12/1988 |
| JP | 8-125487 | 5/1996 |
| JP | 9-161640 | 6/1997 |
| WO | WO99/46624 | 9/1999 |

OTHER PUBLICATIONS

TDB–ACC–NO: NB8406827, "Integral Power Resistors For Aluminum Substrate", IBM Technical Disclosure Bulletin, Jun. 1984, US, vol. 27, Issue No. IB, p. 827.

(Continued)

*Primary Examiner*—Elvin Enad
*Assistant Examiner*—Lisa Klaus

(57) ABSTRACT

Fluid-based switches and a method for producing the same are disclosed. In one embodiment, the switch comprises first and second mated substrates defining therebetween at least portions of a number of cavities, a plurality of electrodes exposed within one or more of the cavities, a switching fluid that serves to open and close at least a pair of electrodes in response to forces applied to the switching fluid, a surface tension modifier coating at least a portion of the switching fluid, and an actuating fluid, held within one or more of the cavities, that applies the forces to the switching fluid.

15 Claims, 5 Drawing Sheets

U.S. PATENT DOCUMENTS 4,988,157 A 1/1991 Jackel et al.
5,105,433 A * 4/1992 Eisele et al. ..... 372/50
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 11/2001 Kondoh et al.
6,351,579 B1 2/2002 Early et al.
6,356,679 B1 3/2002 Kapany
6,373,356 B1 4/2002 Gutierrez et al.
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet et al.
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 5/2003 Zarev
6,633,213 B1 10/2003 Dove
6,646,527 B1 * 11/2003 Dove et al. ..... 335/47
2002/0037128 A1 3/2002 Burger et al.
2002/0146197 A1 10/2002 Yong
2002/0150323 A1 10/2002 Nishida et al.
2002/0168133 A1 11/2002 Saito
2003/0035611 A1 2/2003 Shi

OTHER PUBLICATIONS

Bhedwar, Homi C., et al. "Ceramic Multilayer Package Fabrication", Electronic Materials Handbook, Nov. 1989, pp 460–469, vol. 1 Packaging, Section 4: Packages.

Kim, Joonwon, et al., "A Micromechanical Switch With Electrostatically Driven Liquid–Metal Droplet", Sensors And Actuators, A; Physical v 9798, Apr. 1, 2002, 4 pages.

Marvin Glenn Wong, U.S. Appl. No. 10/137,691 (pending), "A Piezoelectrically Actuated Liquid Metal Switch", filed May 2, 2002.

J. Simons, et al., "A Liquid–Filled Microrelay with a Moving Mercury Microdrop", Journal of Microelectromechanical Systems, vol. 6, No. 3, Sep. 1997, pp. 208–216.

* cited by examiner

FLUID-BASED SWITCH

BACKGROUND OF THE INVENTION

Fluid-based switches, such as liquid metal micro switches (LIMMS) have been made that use a liquid metal, such as mercury, as the switching element. The liquid metal may make, break, or latch electrical contacts. Alternately, a LIMMS may use an opaque liquid to open or block light paths. To change the state of the switch, a force is applied to the switching element. The force must be sufficient to overcome the surface tension of the liquid used as the switching element.

SUMMARY OF THE INVENTION

In one embodiment, a switch comprising first and second mated substrates is disclosed. The substrates define between them at least portions of a number of cavities. A plurality of electrodes is exposed within one or more of the cavities. One or more of the cavities holds a switching fluid that opens and closes at least a pair of electrodes in response to forces applied to the switching fluid by an actuating fluid held within one or more of the cavities. At least a portion of the switching fluid is coated with a surface tension modifier.

BRIEF DESCRIPTION OF THE DRAWINGS

Illustrative embodiments of the invention are illustrated in the drawings in which.

DETAILED DESCRIPTION

Figure 1:
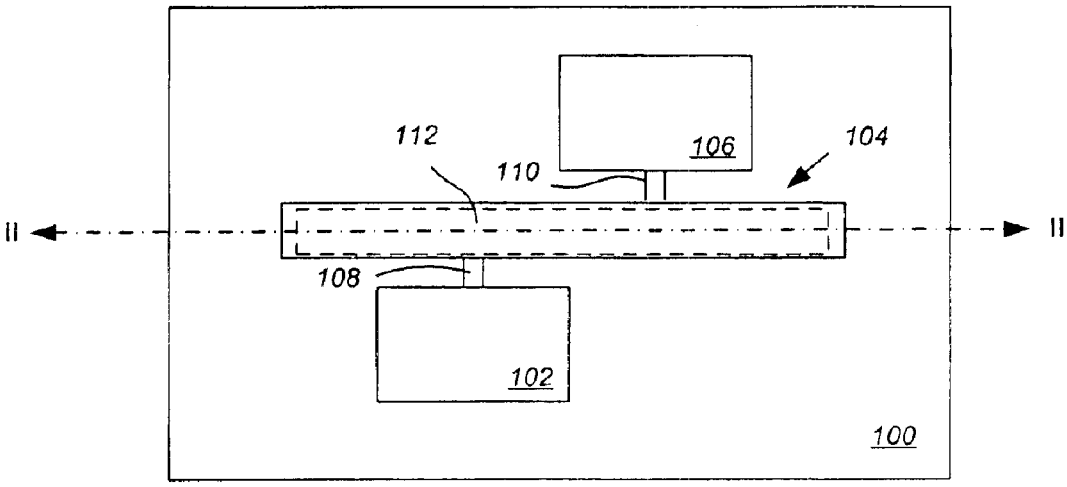
FIG. 1 illustrates an exemplary plan view of a substrate including a surface tension modifier.
Figure 2:
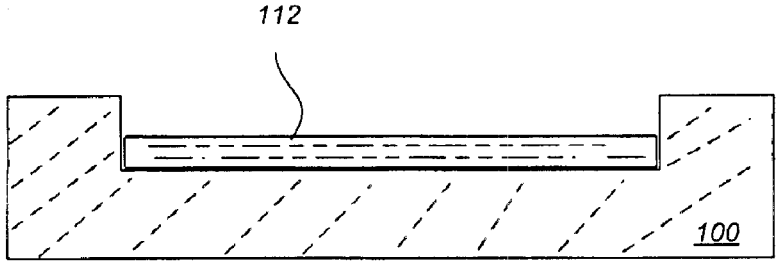
FIG. 2 is an elevation view of the substrate shown in FIG. 1.

FIGS. 1 and 2 illustrate a substrate 100 for a fluid based-switch such as a LIMMS. The substrate 100 includes a switching fluid channel 104, a pair of actuating fluid channels 102, 106, and a pair of channels 108, 110 that connect corresponding ones of the actuating fluid channels 102, 106 to the switching fluid channel 104. It is envisioned that more or fewer channels may be formed in the substrate, depending on the configuration of the switch in which the substrate is to be used. For example, the pair of actuating fluid channels 102, 106 and pair of connecting channels 108, 110 may be replaced by a single actuating fluid channel and single connecting channel.

The substrate 100 further includes a surface tension modifier 112 deposited in the switching fluid channel 104. By way of example, the surface tension modifier may be deposited into the switching fluid channel 104 using a syringe. Other methods may also be used to deposit the surface tension modifier into the switching fluid channel. Although FIG. 1 depicts the surface tension modifier deposited throughout the switching channel, it should be appreciated that in alternate embodiments the surface tension modifier may only be deposited in a portion of the switching fluid channel. By way of example, the surface tension modifier may only be deposited where the switching fluid channel 104 connects with the actuating fluid channels 102, 106.

As will be described in more detail below, the surface tension modifier 112 may be used to coat at least a portion of the switching fluid used in a fluid based switch. The composition of the surface tension modifier may be selected so that it reduces the surface tension of the switching fluid. By way of example, a surface tension modifier may be selected that has an affinity for the switching fluid and some affinity for the actuating fluid used to apply a force to the switching fluid to cause the switch to change state. In one embodiment, the switching fluid comprises liquid metal, such as mercury or a gallium-bearing alloy and the surface tension modifier comprises an inert liquid with an affinity for metal, such as abietic acid dissolved in a suitable nonreactive low viscosity fluid, such as 3M Fluorinert. It should be appreciated that other surface tension modifiers may be used.

By reducing the surface tension of the switching fluid, the power requirements to cause the switch to change state may also be reduced. This may lead to benefits such as lower, more consistent drive power and decreased cooling requirements for the switch.

Figure 3:
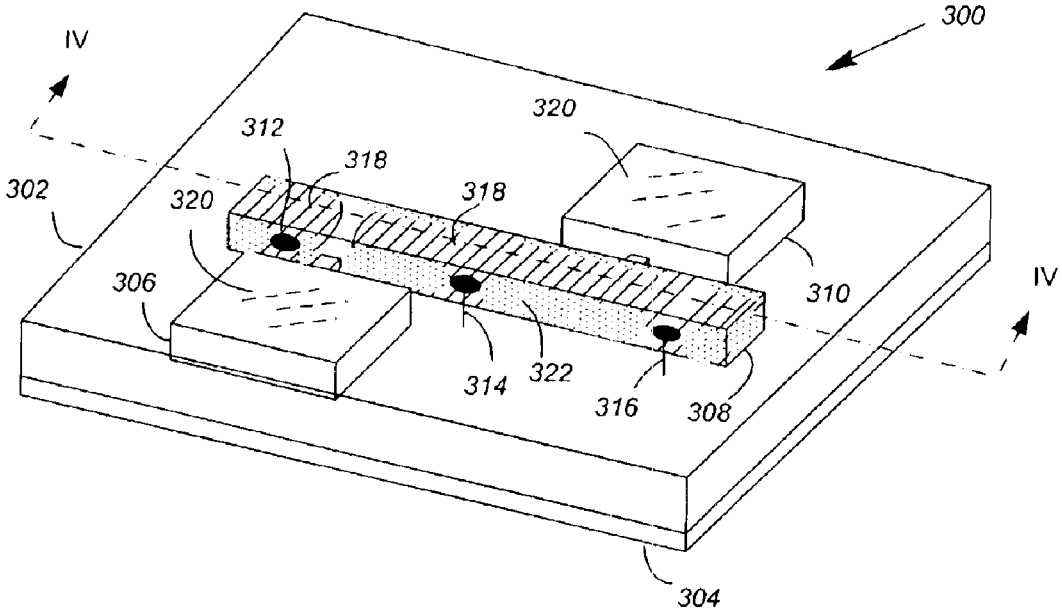
FIG. 3 illustrates a perspective view of a first exemplary embodiment of a switch including a surface tension modifier.
Figure 4:
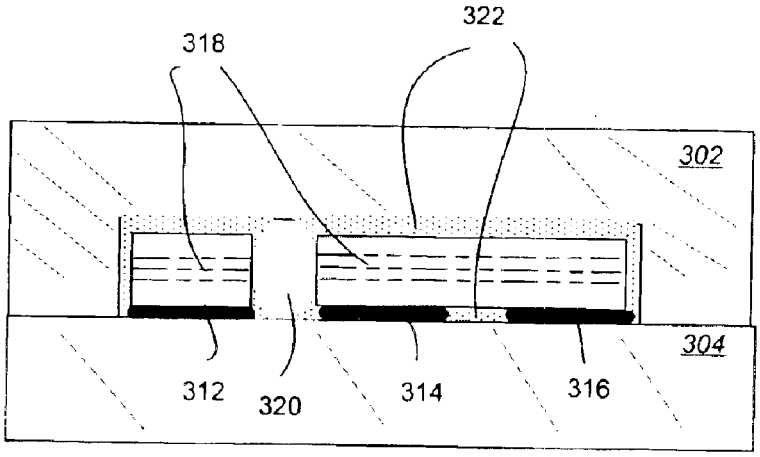
FIG. 4 is an elevation view of the switching fluid cavity of the switch shown in FIG. 3.

FIGS. 3 and 4 illustrate a first exemplary embodiment of a fluid-based switch including a surface tension modifier. The switch 300 comprises a first substrate 302 and a second substrate 304 mated together. The substrates 302 and 304 define between them a number of cavities 306, 308, and 310. Exposed within one or more of the cavities are a plurality of electrodes 312, 314, 316. A switching fluid 318 (e.g., a conductive liquid metal such as mercury) held within one or more of the cavities serves to open and close at least a pair of the plurality of electrodes 312–316 in response to forces that are applied to the switching fluid 318. An actuating fluid 320 (e.g., an inert gas or liquid) held within one or more of the cavities serves to apply the forces to the switching fluid 318.

In one embodiment of the switch 300, the forces applied to the switching fluid 318 result from pressure changes in the actuating fluid 320. The pressure changes in the actuating fluid 320 impart pressure changes to the switching fluid 318, and thereby cause the switching fluid 318 to change form, move, part, etc. In FIG. 3, the pressure of the actuating fluid 320 held in cavity 306 applies a force to part the switching fluid 318 as illustrated. In this state, the rightmost pair of electrodes 314, 316 of the switch 300 are coupled to one another. If the pressure of the actuating fluid 320 held in cavity 306 is relieved, and the pressure of the actuating fluid 320 held in cavity 310 is increased, the switching fluid 318 can be forced to part and merge so that electrodes 314 and 316 are decoupled and electrodes 312 and 314 are coupled.

By way of example, pressure changes in the actuating fluid 320 may be achieved by means of heating the actuating fluid 320, or by means of piezoelectric pumping. The former is described in U.S. Pat. No. 6,323,447 of Kondoh et al. entitled "Electrical Contact Breaker Switch, Integrated Electrical Contact Breaker Switch, and Electrical Contact Switching Method", which is hereby incorporated by reference for all that it discloses. The latter is described in U.S. patent application Ser. No. 10/137,691 of Marvin Glenn Wong filed May 2, 2002 and entitled "A Piezoelectrically Actuated Liquid Metal Switch", which is also incorporated by reference for all that it discloses. Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity. Additional details concerning the construction and operation of a switch such as that which is illustrated in FIG. 3 may be found in the afore-mentioned patent of Kondoh.

Switch 300 further includes surface tension modifier 322 coating switching fluid 318. Surface tension modifier 322 may coat the surface of the switching fluid where it is not sealed to electrodes 312, 314, 316. In alternate embodiments, surface tension modifier 322 may coat only a portion of switching fluid 318 where the switching fluid 318 will be making or breaking contact.

The composition of the surface tension modifier may be selected so that it reduces the surface tension of switching fluid 318. For example, the surface tension modifier may be a liquid that has an affinity for switching fluid 318 and some affinity for actuating fluid 320 (e.g., abietic acid dissolved in a suitable nonreactive low viscosity fluid, such as 3M Fluorinert). In one embodiment, using surface tension modifier 322 to reduce the surface tension of switching fluid 318 also reduces the power requirements to cause the switch to change state.

Figure 5:
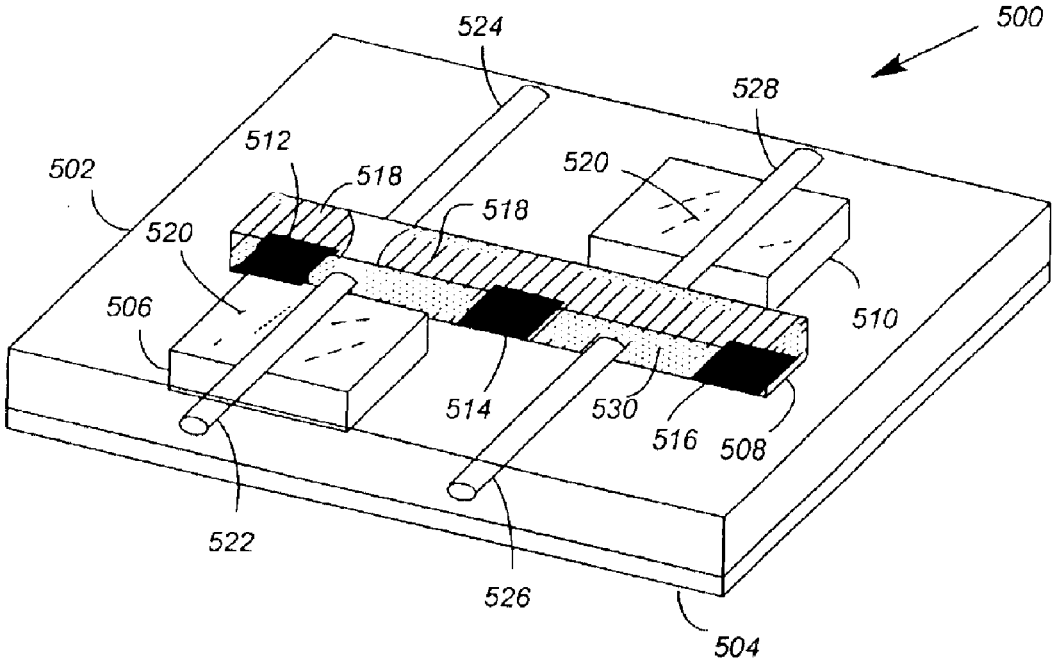
FIG. 5 illustrates a perspective view of a second exemplary embodiment of a switch including a surface tension modifier.

FIG. 5 illustrates a second exemplary embodiment of a switch 500. The switch 500 comprises a substrate 502 and a second substrate 504 mated together. The substrates 502 and 504 define between them a number of cavities 506, 508, 510. Exposed within one or more of the cavities are a plurality of wettable pads 512–516. A switching fluid 518 (e.g., a liquid metal such as mercury) is wettable to the pads 512–516 and is held within one or more of the cavities. The switching fluid 518 serves to open and block light paths 522/524, 526/528 through one or more of the cavities, in response to forces that are applied to the switching fluid 518. By way of example, the light paths may be defined by waveguides 522–528 that are aligned with translucent windows in the cavity 508 holding the switching fluid. Blocking of the light paths 522/524, 526/528 may be achieved by virtue of the switching fluid 518 being opaque. An actuating fluid 520 (e.g., an inert gas or liquid) held within one or more of the cavities serves to apply the forces to the switching fluid 518.

Switch 500 additionally includes surface tension modifier 530 coating at least a portion of switching fluid 518. Forces may be applied to the switching 518 and actuating 520 fluids in the same manner that they are applied to the switching and actuating fluids 318, 320 in FIG. 3. By using a surface tension modifier 530 to reduce the surface tension of switching fluid 518, the power requirements to cause the switch to change state may also be reduced.

Additional details concerning the construction and operation of a switch such as that which is illustrated in FIG. 5 may be found in the aforementioned patent of Kondoh et al., and patent application of Marvin Wong.

Figure 6:
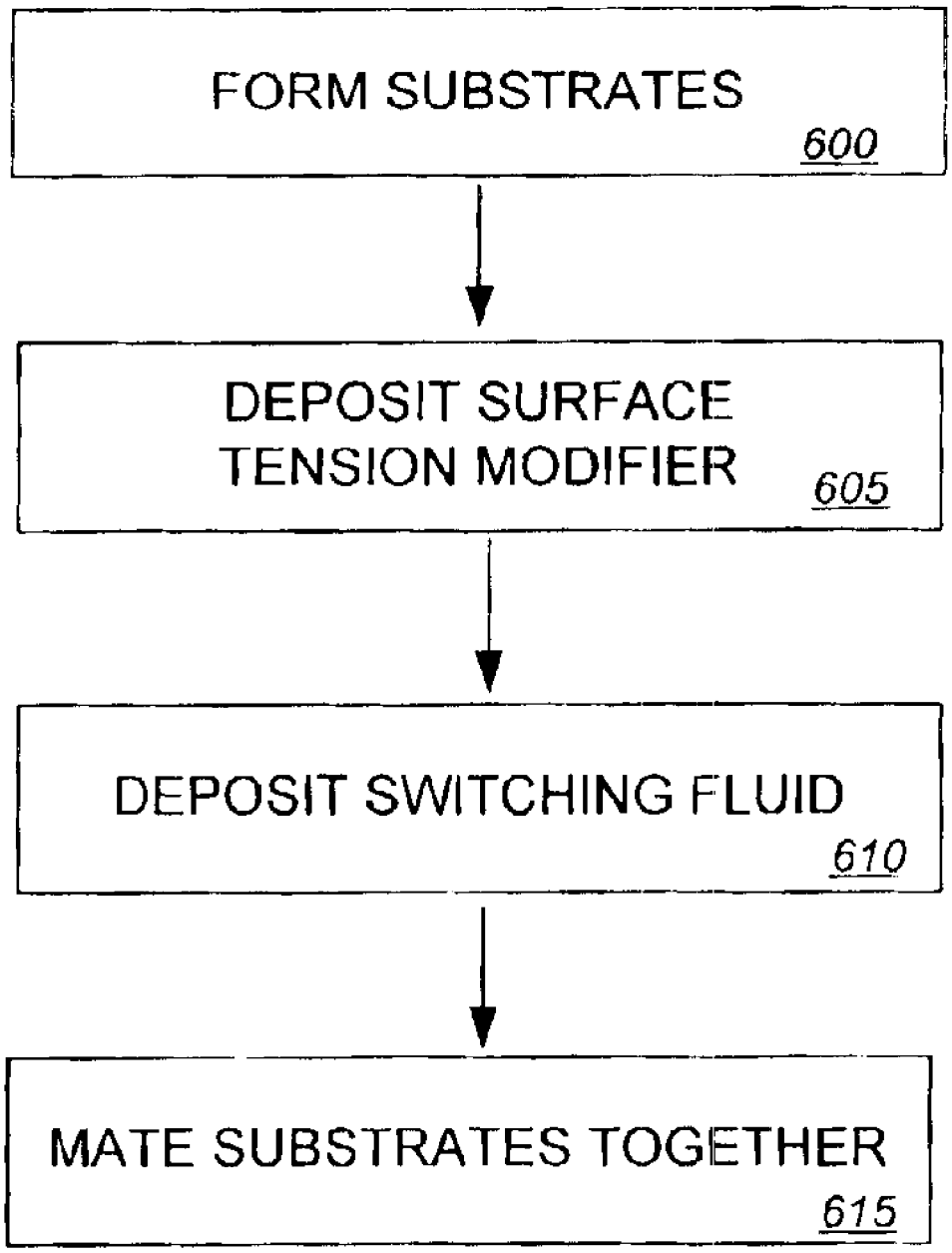
FIG. 6 illustrates an exemplary method for producing a fluid-based switch.

An exemplary method for making a fluid-based switch is illustrated in FIG. 6. The method commences with forming 600 at least two substrates, so that the substrates mated together define between them portions of a number of cavities. Next, a surface tension modifier 605 is deposited on at least a portion of one of the substrates. A switching fluid is also deposited 610 on the other substrate. It should be appreciated that the surface tension modifier and the switching fluid may be deposited at any time and in any order before the substrates are mated together 615.

In one embodiment, the surface tension modifier may be deposited by using a small diameter syringe to dispense surface tension modifier on the substrate at a location that will be within a cavity holding the switching fluid. It should be appreciated that alternate means of depositing surface tension modifier are also contemplated. By way of example, surface tension modifier may be applied as a layer to the substrate at a location that will result in switching fluid being coated with surface tension modifier where a cavity holding switching fluid connects with one or more cavities holding actuating fluid. Alternately, surface tension modifier may be deposited directly on switching fluid before the substrates are mated together.

Figure 7:
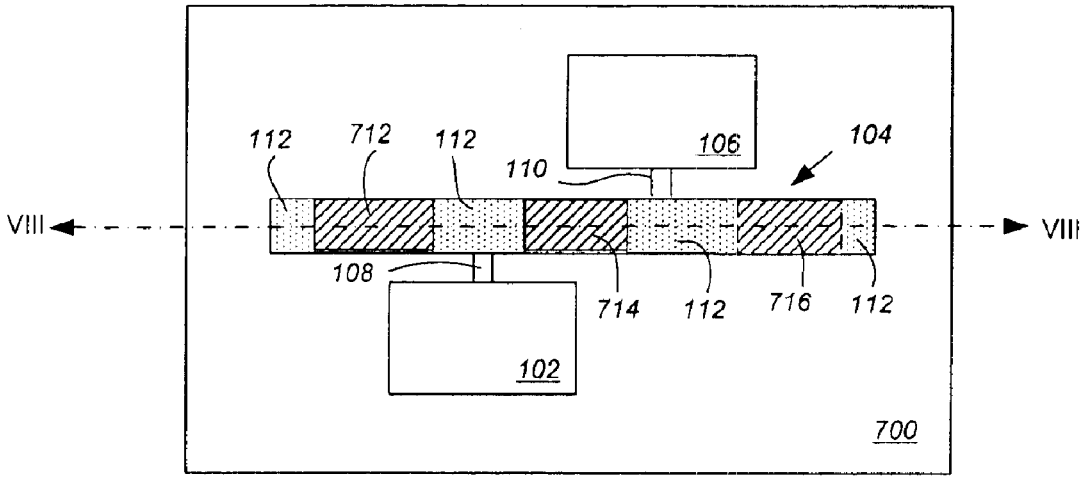
FIG. 7 illustrates an exemplary plan view of a substrate including seal belts.
Figure 8:
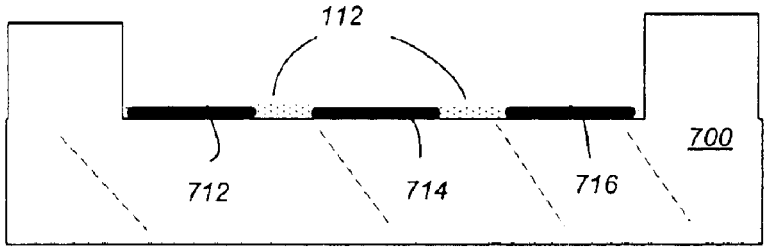
FIG. 8 is an elevation view of the substrate shown in FIG. 7.

FIGS. 7 & 8 illustrate a substrate 700 for a fluid-based switch that includes seal belts 712, 714, and 716. As shown, the substrate 700 may have channels 102–110 formed therein, as previously described with respect to the substrate 100. Seal belts 712, 714, 716 may be made of a wettable material, such as metal or metal alloys. Surface tesnion modifier 112 may be deposited on substrate 700 so that when the substrate 700 is mated with a second substrate, surface tension modifier 112 coats a switching fluid everywhere switching fluid is not wetting to a wettable surface (e.g., seal belts 712, 714, 716 and contacts). Alternately surface tension modifier 112 may be deposited in locations so that it coats only a portion of switching fluid that makes and breaks contact. The use of seal belts within a switching fluid channel may provide additional surface areas to which a switching fluid may wet. This not only helps in latching the various states that a switching fluid can assume, but also helps to create a sealed chamber from which the switching fluid cannot escape, and within which the switching fluid may be more easily pumped (i.e., during switch state changes).

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A switch comprising:

first and second mated substrates defining therebetween at least portions of a number of cavities;

a plurality of electrodes exposed within one or more of the cavities;

a switching fluid held within one or more of the cavities, that serves to open and close at least a pair of the plurality of electrodes in response to forces that are applied to the switching fluid;

a surface tension modifier coating at least a portion of the switching fluid; and an actuating fluid, held within or more of the cavities, that applies the forces to said switching fluid.

2. The switch of claim 1, wherein the surface tension modifier comprises a composition that reduces the surface tension of the switching fluid.

3. The switch of claim 1, wherein the surface tension modifier comprises an inert liquid with an affinity for the switching fluid.

4. The switch of claim 3, wherein the switching fluid comprises a liquid metal.

5. The switch of claim 4, wherein the liquid metal comprises mercury.

6. The switch of claim 4, wherein the liquid metal comprises a gallium-bearing alloy.

7. The switch of claim 6, wherein the low viscosity fluid comprises 3M Fluorinert.

8. The switch of claim 1, wherein the surface tension modifier comprises abietic acid dissolved in a low viscosity fluid.

9. A method comprising:

depositing a surface tension modifier on at least one of the first and second substrates; depositing a switching fluid on at least one of the first and second substrates; and mating the first substrate with the second substrate, thereby defining a cavity holding at least a portion of the surface tension modifier and the switching fluid, and thereby forcing the surface tension modifier to coat at least a portion of the switching fluid.

10. The method of claim 9, further comprising selecting a composition of the surface tension modifier so that it reduces the surface tension of the switching fluid.

11. The method of claim 9, wherein depositing a surface tension modifier comprises using a syringe to inject the surface tension modifier into a cavity holding the switching fluid.

12. The method of claim 9, wherein the switching fluid comprises a liquid metal.

13. The method of claim 9, wherein the surface tension modifier comprises abietic acid dissolved in a low viscosity fluid.

14. The method of claim 9, wherein the surface tension modifier and the switching fluid are deposited on at least the same substrate.

15. The method of claim 9, wherein the surface tension modifier and the switching fluid are deposited on different ones of the substrates.

* * * * *

UNITED STATES PATENT AND TRADEMARK OFFICE

CERTIFICATE OF CORRECTION

PATENT NO. : 6,906,271 B2
DATED : June 14, 2005
INVENTOR(S) : Fong et al.

It is certified that error appears in the above-identified patent and that said Letters Patent is hereby corrected as shown below:

Column 4,
Line 52, after "fluid" insert -- , --.
Line 58, after "within" insert -- one --.

Signed and Sealed this

Seventh Day of February, 2006

JON W. DUDAS
*Director of the United States Patent and Trademark Office*